US009440439B2

(12) United States Patent
Taga et al.

(10) Patent No.: US 9,440,439 B2
(45) Date of Patent: Sep. 13, 2016

(54) INK-JET HEAD AND INK-JET RECORDING APPARATUS

(71) Applicants: Yasuhiro Taga, Inuyama (JP); Masaya Fujioka, Nagoya (JP)

(72) Inventors: Yasuhiro Taga, Inuyama (JP); Masaya Fujioka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 72 days.

(21) Appl. No.: 13/851,326

(22) Filed: Mar. 27, 2013

(65) Prior Publication Data

US 2013/0321530 A1 Dec. 5, 2013

(30) Foreign Application Priority Data

May 31, 2012 (JP) ..... 2012-125492

(51) Int. Cl.
*B41J 2/165* (2006.01)
*B41J 2/14* (2006.01)

(52) U.S. Cl.
CPC ..... *B41J 2/14* (2013.01); *B41J 2/14233* (2013.01)

(58) Field of Classification Search
None
See application file for complete search history.

(56) References Cited

U.S. PATENT DOCUMENTS

| | | | | |
|---|---|---|---|---|
| 5,609,671 | A | 3/1997 | Nagasawa | |
| 5,837,045 | A | 11/1998 | Johnson et al. | |
| 6,350,017 | B1 | 2/2002 | Kamada | |
| 7,520,596 | B2 * | 4/2009 | Yasui | 347/71 |
| 8,016,404 | B2 | 9/2011 | Kato et al. | |
| 2003/0156156 | A1 * | 8/2003 | Sakaida et al. | 347/47 |
| 2004/0095439 | A1 * | 5/2004 | Takahashi | B41J 2/14274 347/68 |
| 2006/0061622 | A1 * | 3/2006 | Suzuki | 347/47 |
| 2006/0201380 | A1 | 9/2006 | Kowalski et al. | |
| 2007/0100023 | A1 | 5/2007 | Burns et al. | |
| 2007/0100024 | A1 | 5/2007 | Gu et al. | |
| 2008/0241398 | A1 | 10/2008 | Kato et al. | |
| 2010/0289858 | A1 | 11/2010 | Anton | |
| 2012/0056944 | A1 | 3/2012 | Shimada | |

FOREIGN PATENT DOCUMENTS

| | | | |
|---|---|---|---|
| JP | 08-003498 | A | 1/1996 |
| JP | 2000-513396 | A | 10/2000 |
| JP | 2000-334946 | A | 12/2000 |
| JP | 2003-136714 | A | 5/2003 |
| JP | 2008-524400 | A | 7/2008 |
| JP | 2008-246821 | A | 10/2008 |
| JP | 2009-515007 | A | 4/2009 |
| JP | 2010-094880 | A | 4/2010 |
| JP | 2011-515504 | A | 5/2011 |
| WO | 2010/150012 | A1 | 12/2010 |

OTHER PUBLICATIONS

Extended EP Search Report mailed Sep. 23, 2013, EP Appln. 13161412.5-1701.

* cited by examiner

*Primary Examiner* — Alejandro Valencia
(74) *Attorney, Agent, or Firm* — Banner & Witcoff, Ltd.

(57) ABSTRACT

The inkjet head for discharging a water-based ink for inkjet recording is disclosed, the inkjet head including two or more types of metal members used at portions to be brought in contact with the water-based ink, wherein at least two of the two or more types of the metal members are electrically connected, and the two or more types of the electrically connected metal members have spontaneous potentials each of which is measured with a reference electrode Ag/AgCl in the water-based ink and which provide an absolute value of a maximum difference therebetween, the absolute value being not more than 60 mV. An ink jet head is provided, in which any corrosion of a metal member is suppressed.

9 Claims, 3 Drawing Sheets

INK-JET HEAD AND INK-JET RECORDING APPARATUS

CROSS REFERENCE TO RELATED APPLICATION

The present application claims the priority based on Japanese Patent Application No. 2012-125492 filed on May 31, 2012, and the entire disclosure of Japanese Patent Application No. 2012-125492 is incorporated herein by reference.

BACKGROUND OF THE INVENTION

1. Field of the Invention

The present teaching relates to an ink-jet head and an ink-jet recording apparatus.

2. Description of the Related Art

An ink-jet head, which uses a metal member at a portion to be brought in contact with a water-based ink, is utilized in an ink-jet recording apparatus. However, the ink-jet head as described above has such a fear that the metal member may be corroded by the water-based ink (metal may be eluted into the water-based ink). Published Japanese Translation of PCT International Publication for Patent Application No. 2011-515504 relates to such an ink-jet print head that a part of an ink flow passage is formed of nickel or nickel alloy, for which a water-based ink-jet ink containing a specified additive of random hydrophilic polymer is used, and thus the corrosion resistance of the ink flow passage is improved.

It is desirable to provide an ink-jet head which has the excellent corrosion resistance against the water-based ink without using any specified additive for the water-based ink unlike the technique as described above. Further, it is also required that the ink-jet head, which is to be used for the general purpose type ink-jet printer, should be produced at low cost, and the ink-jet head should be produced with ease.

SUMMARY OF THE INVENTION

In view of the above, an object of the present teaching is to provide an ink-jet head in which a metal member is suppressed from being corroded by a water-based ink. Another object of the present teaching is to provide an ink-jet head in which an ink flow passage is suppressed from being corroded by a water-based ink and which can be produced easily at low cost.

In order to achieve the foregoing object, according to a first aspect of the present teaching, there is provided an ink-jet head for discharging a water-based ink for ink-jet recording, the ink-jet head having portions which are to be brought in contact with the water-based ink and which are formed by two or more types of metal members, wherein: at least two of the two or more types of the metal members are electrically connected; and the two or more types of the electrically connected metal members have spontaneous potentials each of which is measured with a reference electrode Ag/AgCl in the water-based ink and which provide an absolute value of a maximum difference therebetween, the absolute value being not more than 60 mV.

As described above, in the ink-jet head of the present teaching, the two or more types of the metal members are used at the portions which are to be brought in contact with the water-based ink. It is desirable that all of the portions to be brought in contact with the water-based ink are ideally formed of any metal having the high corrosion resistance.

However, in such a case, the production cost of the ink-jet head becomes expensive. On the other hand, it is sometimes desirable that a metal, which has the favorable processing performance, is used depending on the part formed of metal. In order to respond to the demand as described above, the two or more types of the metal members are used for the portions of the ink-jet head to be brought in contact with the water-based ink. In the present teaching, the absolute value of the maximum difference is not more than 60 mV between the spontaneous potentials of the two or more types of the metal members as measured in the water-based ink. Accordingly, even when the two or more types of the metal members are used in the ink-jet head of the present teaching, then the movement of the electric charge, which is caused between the metal members, is suppressed, and the corrosion is suppressed for the metal members as a whole.

According to a second aspect of the present teaching, there is provided an ink-jet head for discharging a water-based ink for ink-jet recording, the ink-jet head including: a flow passage unit which is formed with a plurality of nozzles, a plurality of pressure chambers corresponding to the plurality of nozzles, and a common liquid chamber for accommodating the ink to be supplied to the plurality of pressure chambers; and an actuator which pressurizes the ink contained in the plurality of pressure chambers, wherein: the common liquid chamber of the flow passage unit is formed by stacking a plurality of metal plates, and at least one of the plurality of metal plates is formed of a metal which is different in an elution property for the ink from a metal or metals of the other metal plate or metal plates.

According to a third aspect of the present teaching, there is provided an ink-jet recording apparatus including: an ink accommodating unit which accommodates a water-based ink for ink-jet recording and the ink-jet head as defined in the first or second aspect which discharges the water-based ink for ink-jet recording accommodated in the ink accommodating unit.

DESCRIPTION OF THE PREFERRED EMBODIMENT

In the present teaching, the "two or more types of the electrically connected metal members" mean the two or more types of the metal members having different spontaneous potentials as measured with the reference electrode Ag/AgCl in the water-based ink, which include not only the two or more types of the metal members having different compositions but also the two or more types of the metal members having different spontaneous potentials on account of, for example, any difference in the surface state brought about by the difference in the surface treatment, even when the two or more types of the metal members have the same composition.

In the present teaching, the "first metal member which has the highest corrosion resistance against the water-based ink among the two or more types of the metal members" means, for example, such a metal member that the elution amount of the metal into the water-based ink is the smallest when the two or more types of the metal members are immersed in the water-based ink respectively. In the present teaching, the "second metal member which has the lowest corrosion resistance against the water-based ink among the two or more types of the metal members" means, for example, such a metal member that the elution amount of the metal into the water-based ink is the largest when the two or more types of the metal members are immersed in the water-based ink respectively.

As described above, the ink-jet head of the present teaching resides in the ink-jet head for discharging the water-based ink for ink-jet recording (hereinafter referred to as "water-based ink" or "ink" in some cases), the ink-jet head having the portions to be brought in contact with the water-based ink, especially an ink flow passage which is/are formed by the two or more types of metal members. Further, at least two of the two or more types of the metal members are electrically connected, and the two or more types of the electrically connected metal members have the spontaneous potentials each of which is measured with the reference electrode Ag/AgCl in the water-based ink and which provide the absolute value of the maximum difference therebetween, the absolute value being not more than 60 mV. It is enough for the ink-jet head of the present teaching that the two or more types of the metal members, in which the absolute value of the maximum difference between the spontaneous potentials is not more than 60 mV, are used at the portions to be brought in contact with the water-based ink. The construction and the shape other than the above are not specifically limited.

Figure 1:
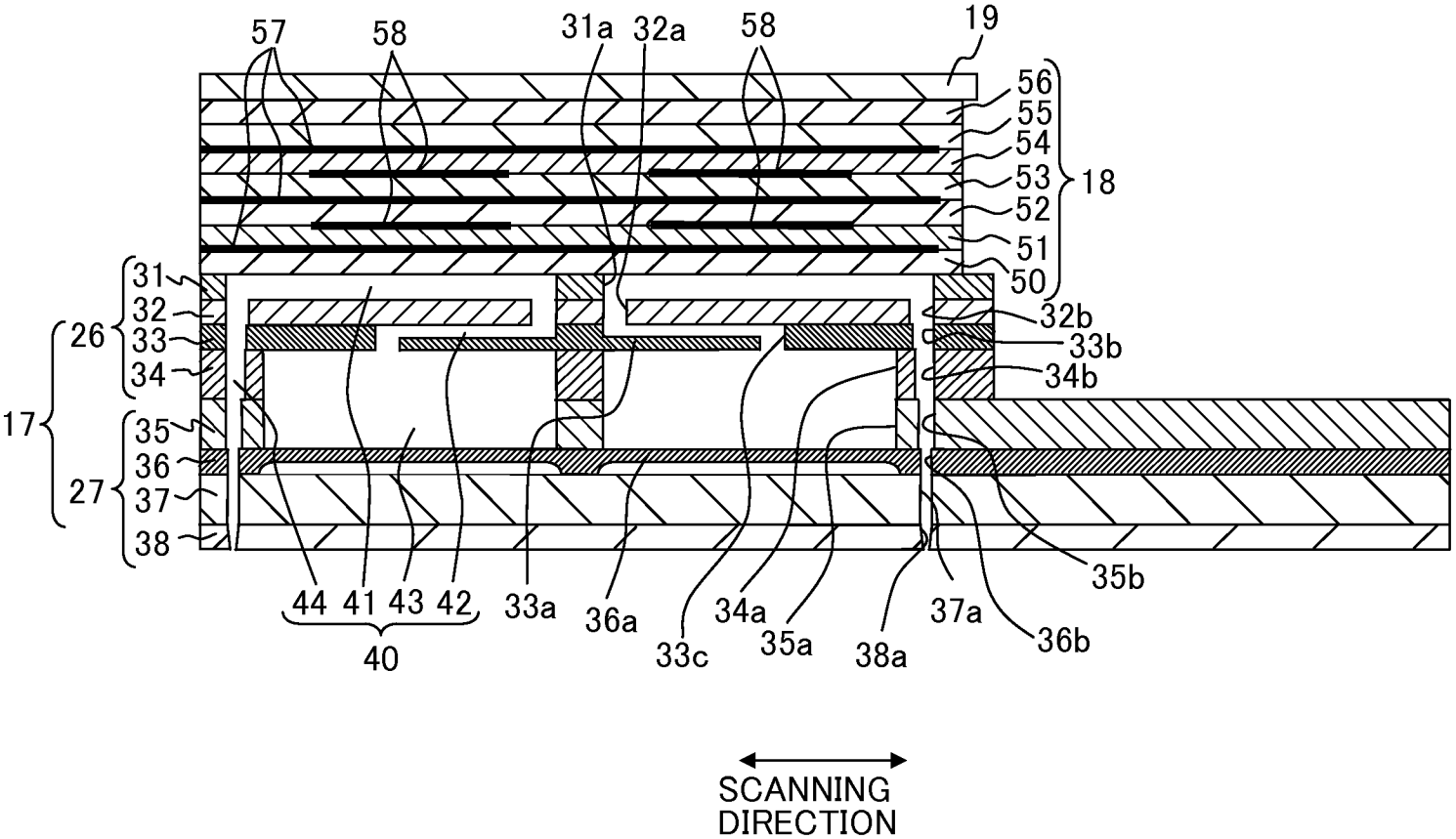
FIG. 1 shows a sectional view illustrating an exemplary arrangement of an ink-jet head of the present teaching.
Figure 2:
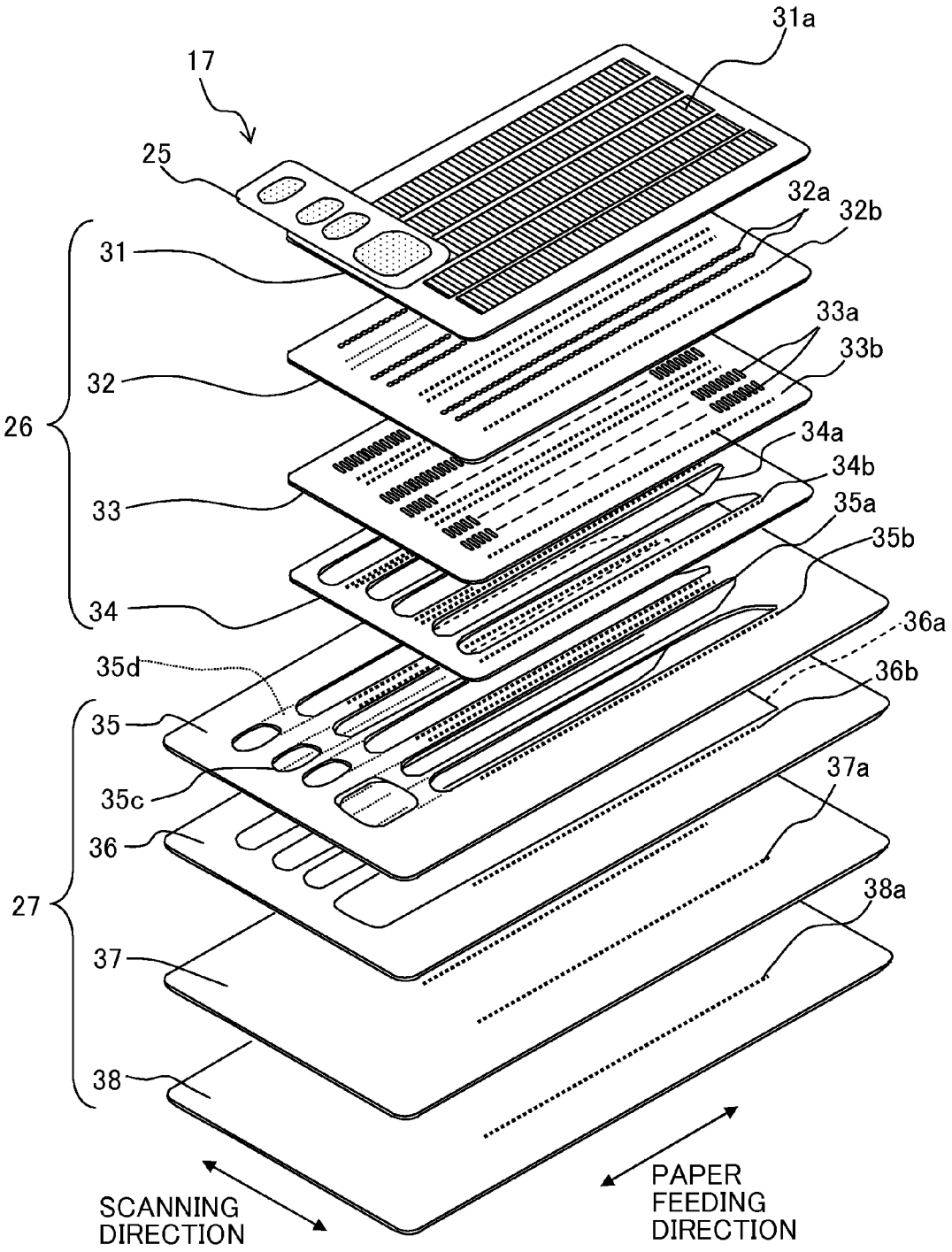
FIG. 2 shows an exploded perspective view illustrating the exemplary arrangement of the ink-jet head shown in FIG. 1.

A sectional view shown in FIG. 1 and an exploded perspective view shown in FIG. 2 illustrate an exemplary arrangement of the ink-jet head according to the present teaching. As shown in FIGS. 1 and 2, in this ink-jet head, a plate type actuator 18 is joined to a flow passage unit 17 provided with a plurality of plates, and a flexible flat cable 19, which is provided to effect the connection to an external apparatus, is placed (superimposed) and joined on the upper surface of the actuator 18. The water-based ink is discharged in the downward direction from nozzles 38*a* which are open on the lower surface side of the flow passage unit 17.

The flow passage unit 17 is composed of a narrow width portion 26 and a wide width portion 27. The flow passage unit 17 is constructed such that a pressure chamber plate 31, a spacer plate 32, a throttle plate 33, a first manifold plate 34, a second manifold plate 35, a damper plate 36, a cover plate 37, and a nozzle plate 38 are stacked in this order from the top and they are adhered by using, for example, an epoxy-based adhesive. The thickness of each of the plates 31 to 38 is, for example, 30 μm to 1.5 mm. The narrow width portion 26 has such a substantially rectangular shape that the planar shape thereof is smaller in the short side direction (scanning direction) and the long side direction (paper feeding direction) than the planar shape of the wide width portion 27. Further, the planar shape of the narrow width portion 26 is substantially the same as the planar shape of the actuator 18.

In the flow passage unit 17, the nozzle plate 38 is a sheet made of resin such as polyimide or the like, and the other respective plates 31 to 37 are metal plates. In this embodiment, at least two of the respective plates 31 to 37 of the flow passage unit 17 are the two or more types of the metal members described above. At least two of the two or more types of the metal members are electrically connected. The electric connection includes not only such a situation that the electric connection is provided on account of the direct contact as brought about, for example, between the pressure chamber plate 31 and the spacer plate 32 but also such a situation that the electric connection is provided by the aid of another metal member and the water-based ink introduced into an ink flow passage 40 as described later on as brought about, for example, between the pressure chamber plate 31 and the cover plate 37.

Any material is usable as the material for forming the two or more types of the metal members, provided that the absolute value of the maximum difference is not more than 60 mV between the spontaneous potentials of the electrically connected two or more types of the metal members as measured with the reference electrode Ag/AgCl in the water-based ink. However, there are exemplified, for example, NK-430MA, SUS444, SUS304, SUS430, SUS430BA, 42 Alloy (nickel content: about 42%, iron content: about 58%), SUS303, SUS304L, SUS430J1L, SUS440A, SUS440B, SUS440C, SUS410, SUS443J1, NNS442M3, Ni, and Ti. NK-430MA is an improved product of SUS430 produced by Nippon Kinzoku Co., Ltd. SUS430BA is produced by applying a surface treatment (bright anneal treatment) to SUS430 (bright heat treatment finishing is performed after cold rolling, followed by performing cold rolling a little in order to enhance glossiness). SUS304L is extremely low carbon steel produced by decreasing the content of carbon in relation to SUS304. SUS430J1L is a steel material produced by adding Cu and Nb to SUS430 to provide extremely low C, N. NNS442M3 (produced by Nisshin Steel Co., Ltd.) is an improved product of SUS430. Table 1 shows main chemical components of the representative SUS materials of those described above. In Table 1, the component composition is expressed by atomic %, and the remaining component is Fe. When the absolute value of the maximum difference is not more than 60 mV, the corrosion is suppressed for the metal members as a whole. The spontaneous potential can be measured, for example, by means of the following method. The spontaneous potential slightly differs depending on the type (composition) of the water-based ink. However, even when the type (composition) of the water-based ink is changed, it is possible to obtain the effect of the present teaching, provided that the absolute value of the maximum difference is merely not more than 60 mV. On the contrary, if the absolute value of the maximum difference exceeds 60 mV, the corrosion is easily caused between the two or more types of the metal members, which is not preferred. The absolute value of the maximum difference is preferably above 0 and not more than 30 mV.

<Method for Measuring Spontaneous Potential>

A metal member piece, which has a length of 30 mm, a width of 20 mm, and a thickness of 0.1 mm, is prepared. The metal member piece is immersed for 20 minutes in 150 mL of the water-based ink in a 200 mL beaker. After that, Ag/AgCl is used as the reference electrode to measure the spontaneous potential in the water-based ink. For example, Potentiostat HA-151 produced by Hokuto Denko Corporation can be used to measure the spontaneous potential.

TABLE 1

| | C | Si | Mn | P | S | Ni | Cr | Mo | Others |
|---|---|---|---|---|---|---|---|---|---|
| NK-430MA | ≤0.025 | ≤1.00 | ≤1.00 | ≤0.040 | ≤0.010 | *1 | 19.00-21.00 | — | *2 |
| SUS444 | ≤0.025 | ≤1.00 | ≤1.00 | ≤0.040 | ≤0.030 | *1 | 17.00-20.00 | 1.75-2.50 | |
| SUS304 | ≤0.08 | ≤1.00 | ≤2.00 | ≤0.045 | ≤0.030 | 8.00-10.50 | 18.00-20.00 | — | |
| SUS430 | ≤0.12 | ≤0.75 | ≤1.00 | ≤0.040 | ≤0.030 | *1 | 16.00-18.00 | — | |
| SUS303 | ≤0.15 | ≤1.00 | ≤2.00 | ≤0.20 | ≤0.15 | 8.00-10.00 | 17.00-19.00 | *1 | |
| SUS304L | ≤0.030 | ≤1.00 | ≤2.00 | ≤0.045 | ≤0.030 | 9.00-13.00 | 18.00-20.00 | — | |
| SUS410 | ≤0.15 | ≤1.00 | ≤1.00 | ≤0.040 | ≤0.030 | *1 | 11.50-13.50 | — | |

*1: may be contained by not more than 0.60.
*2: Cu: 0.03-0.60, Nb: not less than 10 × (C + N)

In this embodiment, the positions of arrangement of the two or more types of the electrically connected metal members are not specifically limited. For example, any one of the respective plates 31 to 37 of the flow passage unit 17 may be formed by the two or more types of the metal members. Alternatively, two or more of the respective plates 31 to 37 may be formed by the two or more types of the metal members. In the case of the latter, for example, any one of the respective plates 31 to 37 may be the first metal member, and the other six plates may be the second metal members. Alternatively, any two, three, four, or five of the respective plates 31 to 37 may be the first metal members, and five, four, three, or two thereof other than the above may be the second metal members. Further alternatively, any one of the respective plates 31 to 37 may be the second metal member, and six plates other than the above may be the first metal members. As described above, in view of the corrosion resistance, it is desirable that all of the plates are formed by the first metal members having the high corrosion resistance. However, the metal having the high corrosion resistance is relatively expensive. The metal having the high corrosion resistance is not necessarily excellent in the processing performance. Therefore, it is desirable that the metal having the high corrosion resistance is selectively used at the specified place. In view of the improvement of the corrosion resistance of the metal members as a whole, it is preferable that the first metal member and the second metal member are the metal plates which are stacked adjacently. Preferably, the plates, which are included in the respective plates 31 to 37 and which constitute a common liquid chamber 43 as described later on, are appropriately formed by the two or more types of the metal members. Accordingly, it is possible to efficiently suppress the corrosion in the common liquid chamber 43 which has the large surface area in the ink flow passage 40 connected to the plurality of nozzles 38*a*. For example, it is possible to more efficiently suppress the discharge failure of the ink-jet head which would be otherwise caused by the deposition or precipitation of the component of the pigment or the like contained in the water-based ink. Further, according to this construction, even when a part of the flow passage unit 17 is replaced with the metal plate which easily causes the corrosion, it is possible to suppress the corrosion of the flow passage unit 17 as a whole. Therefore, the range of selection of the material for forming the same is widened, which is advantageous in view of the cost as well. When the different metal members are joined to one another, it is necessary to consider the strain of the ink flow passage caused by the difference in the coefficient of thermal expansion.

According to an experiment performed by the present inventors, the following fact has been revealed. That is, it is especially desirable that both of the damper plate 36 and the throttle plate 33 or only the damper plate 36 is/are formed by the first metal member or metal members, and the remaining plates are formed by the second metal members. As shown in FIG. 1 as well, the damper plate 36 especially has the large area to be brought in contact with the ink contained in the common liquid chamber 43. Therefore, the damper plate 36 is the portion for which the corrosion resistance is required. Further, the damper plate 36 functions as the damper for the pressure fluctuation of the ink. Therefore, the greater part of the damper plate 36 is thin-walled, and the damper plate 36 has the small contact area with respect to the cover plate 37 disposed thereunder. Therefore, even when the damper plate 36 is constructed by the first metal member, and the plates (cover plate 37 and second manifold plate 35 in this embodiment), which exist thereover and thereunder, are constructed by the second metal members, then the influence of the difference in the thermal expansion, which would be caused when the plates of the different metal species (types) are joined, can be suppressed to be small. Therefore, the following construction is advantageous. That is, the damper plate, which has the large area to be brought in contact with the ink and which has the small contact area with respect to the adjoining plates, is constructed by the first metal member, and the plates, which are provided thereover and thereunder, are constructed by using the second metal members which are selected in view of the price and the processing performance.

It is preferable that a ratio $\{(Y/X)\times 100\}$ of a contact area (Y) provided between the water-based ink and the first metal member is not less than 20% with respect to a total (X) of contact areas provided between the water-based ink and the two or more types of the electrically connected metal members. When the ratio is not less than 20%, it is possible to further suppress the corrosion of the metal member as a whole. More preferably, the ratio is not less than 35%.

Openings or grooves are formed for the respective plates 31 to 38 of the flow passage unit 17, for example, by means of the etching, the laser processing, or the plasma jet processing. When the respective plates 31 to 38 are stacked, then the respective openings and the grooves are communicated with each other, and thus the ink flow passages 40 are formed. Details of the respective plates 31 to 38 will be explained below.

A large number of (two thereof are shown in FIG. 1) pressure chamber holes 31*a* are provided for the pressure chamber plate 31. Each of the pressure chamber holes 31*a* has a shape of slotted hole extending in the short side direction (scanning direction) of the pressure chamber plate 31. The pressure chamber holes 31*a* are aligned along the long side (side in the paper feeding direction) of the pressure chamber plate 31, and the pressure chamber holes 31*a* are provided in a plurality of arrays (for example, five arrays) in the short side direction (scanning direction). As for the respective arrays of the pressure chamber holes 31*a*, for example, two arrays are used for the water-based black ink, and each one array is used for each of the water-based yellow ink, the water-based magenta ink, and the water-based cyan ink. An actuator 18 is adhered from the upper position of the pressure chamber plate 31, and the spacer plate 32 is adhered from the lower position, and thus the pressure chamber holes 31*a* form pressure chambers 41 each having an internal space.

The spacer plate 32 is provided with communication holes 32*a* each of which is communicated with one end portion in the scanning direction of the pressure chamber hole 31*a* of the pressure chamber plate 31, and through-holes 32*b* each of which is communicated with the other end portion of the pressure chamber hole 31*a*.

The throttle plate 33 has throttle grooves 33*a* which are formed on the upper surface side. Each of the throttle grooves 33*a* has a long groove-shaped form extending in the short side direction (scanning direction) of the throttle plate 33. One end portion thereof is communicated with the communication hole 32*a* of the spacer plate 32, and a through-hole 33*c*, which penetrates to the lower surface side, is provided on the other end portion. Further, the throttle plate 33 is formed with through-holes 33*b* which are communicated with the through-holes 32*b* of the spacer plate 32. When the throttle plate 33 is adhered while being interposed between the spacer plate 32 and the first manifold plate 34, the throttle grooves 33*a* form throttle passages 42.

The first manifold plate 34 has manifold holes 34*a* which are formed penetratingly therethrough, each of which is positioned under the pressure chamber hole 31*a* corresponding thereto, and each of which is provided to extend in the array direction (paper feeding direction) of each of the arrays of the pressure chamber holes 31*a*. Five arrays of the manifold holes 34*a* are provided in total, including, for example, two arrays for the water-based black ink, and each one array for each of the water-based yellow ink, the water-based magenta ink, and the water-based cyan ink. The manifold hole 34*a* is communicated with the pressure chamber 41 via the through-hole 33*c*, the throttle passage 42, and the communication hole 32*a*. Further, the first manifold plate 34 is formed with through-holes 34*b* which are communicated with the through-holes 33*b* of the throttle plate 33 along with the longitudinal direction of the respective manifold holes 34*a*.

Manifold holes 35*a* and through-holes 35*b*, which have the same shapes as those of the manifold holes 34*a* and the through-holes 34*b* of the first manifold plate 34, are formed penetratingly through the second manifold plate 35. Although not shown in FIG. 1, four ink inflow holes 35*c* (see FIG. 2), which are provided for the water-based inks of the respective colors, are formed while being aligned in the short side direction (scanning direction) at one end portion in the long side direction (paper feeding direction) of the second manifold plate 35.

The throttle plate 33, the first manifold plate 34, the second manifold plate 35, and the damper plate 36 described later on are stacked and adhered, and thus the common liquid chamber 43 is formed by the manifold holes 34*a*, 35*a*.

A communication hole, which is not shown in FIG. 1, is provided in a recessed form from the lower surface side between the ink inflow hole 35*c* and the manifold hole 35*a* of the second manifold plate 35. The damper plate 36 is adhered to the lower portion of the second manifold plate 35. Accordingly, the ink inflow hole 35*c* and the manifold hole 35*a* are communicated with each other, and the water-based ink can be supplied from the ink inflow hole 35*c* to the manifold hole 35*a*. Further, one ink inflow hole 35*c* of the four ink inflow holes 35*c* is larger than the other three ink inflow holes 35*c*, and the larger ink inflow hole 35*c* is communicated with the two arrays of the manifold holes 35*a* for the black ink which is frequently used.

The damper plate 36 has damper walls 36*a* which are recessed from the lower surface side and which are formed to be thin-walled at portions corresponding to the common liquid chambers 43. The damper plate 36 is formed with through-holes 36*b* which are communicated with the through-holes 35*b* of the second manifold plate 35 along with the longitudinal direction of the damper wall 36*a*. The damper plate 36 and the cover plate 37 are stacked and adhered, and thus damper chambers are formed. The damper wall 36*a* is not brought in contact with the cover plate 37 so that the damper wall 36*a* can vibrate in the space between the damper wall 36*a* and the cover plate 37 disposed thereunder.

The cover plate 37 is formed with through-holes 37*a* which are communicated with the through-holes 36*b* of the damper plate 36.

The nozzle plate 38 is formed with nozzles 38*a* which are holes communicated with the through-holes 37*a* of the cover plate 37. The nozzles 38*a* are aligned in parallel, for example, along with the long side direction (paper feeding direction), and the nozzles 38*a* are provided in five arrays in the short side direction (scanning direction). For example, two arrays are used for the water-based black ink, and each one array is used for each of the water-based yellow ink, the water-based magenta ink, and the water-based cyan ink.

The respective plates 31 to 38 are stacked with each other and adhered to one another, and thus the flow passage unit 17 having a protruding cross-sectional shape, which has the narrow width portion 26 disposed at the upper portion and the wide width portion 27 disposed at the lower portion, is formed. The through-holes 32*b*, 33*b*, 34*b*, 35*b*, 36*b*, 37*a*, which are formed through the respective plates 32 to 37, are communicated with each other to form outflow passages 44. The outflow passages 44 are communicated with the nozzles 38*a* of the nozzle plate 38. Accordingly, the water-based ink, which is allowed to inflow from the ink inflow hole 35*c*, is allowed to flow through the common liquid chamber 43, the throttle passage 42, the pressure chamber 41, and the outflow passage 44 in this order, and the water-based ink is discharged from the nozzle 38*a*. That is, the ink flow passage 40 is constructed in the flow passage unit 17 by the ink inflow hole 35*c*, the common liquid chamber 43, the throttle passage 42, the pressure chamber 41, and the outflow passage 44. As shown in FIG. 2, in order to remove any foreign matter mixed in the water-based ink, a filter 25 formed of nickel or the like is attached to the upper surface of the second manifold plate 35 so that the ink inflow hole 35*c* is covered therewith.

As shown in FIG. 1, the actuator 18 is constructed by stacking six piezoelectric sheets 50 to 55 and a top sheet 56 having the insulation performance. The piezoelectric sheet 50, which is provided at the lowermost layer, covers the plurality of pressure chambers 31*a* of the flow passage unit 17. Each of the piezoelectric sheets 50 to 55 is formed of a ceramic material of lead titanate zirconate (PZT) having a thinness of about 30 μm. Common electrodes 57, which are arranged to correspond to all of the pressure chambers 41 of the flow passage unit 17, are formed by printing on the upper surfaces of the odd number piezoelectric sheets 50, 52, 54 as counted upwardly from the lowermost layer piezoelectric sheet 50 of the respective piezoelectric sheets 50 to 55. Further, a large number of individual electrodes 58, which are arranged to individually correspond to the respective pressure chambers 41, are formed by printing on the upper surfaces of the even number piezoelectric sheets 51, 53 as counted upwardly from the lowermost layer piezoelectric sheet 50. Although not shown in FIG. 1, the common electrodes 57 and the individual electrodes 58 are in conduction with surface electrodes provided on the upper surface of the top sheet 56 via relay wirings provided in through-holes or on side end surfaces of the respective piezoelectric sheets 50 to 55 and the top sheet 56.

When the voltage is selectively applied from the flexible flat cable 19 to the plurality of individual electrodes 58 of the actuator 18, then the difference in the electric potential arises between the printed individual electrodes 58 and the common electrodes 57, and the electric field acts on the active portion which is the portion interposed between the common electrodes 57 and the individual electrodes 58 of the piezoelectric sheets 51 to 54 to generate the strain deformation in the stacking direction. Accordingly, the piezoelectric sheet 50, which is disposed at the lowermost layer, protrudes into the pressure chamber 41. Therefore, the water-based ink contained in the pressure chamber 41 is discharged to the outside from the nozzle 38*a* via the outflow passage 44.

This embodiment is illustrative of the ink-jet head having the stacked structure by way of example. However, as described above, it is enough for the ink-jet head of the present teaching that the two or more types of the metal members, in which the absolute value of the maximum difference between the spontaneous potentials is not more than 60 mV, are used at the portions with which the water-based is brought in contact. The construction and the shape other than the above are not specifically limited. For example, the ink-jet head of the present teaching may be produced as follows because the production is performed with ease. That is, the flow passage unit is produced by using one sheet of plate (member not having the stacked structure), and the portions of the flow passage unit, which are brought in contact with the ink, may be formed by the two or more types of the metal members. Also in this case, the absolute value of the maximum difference between the spontaneous potentials is not more than 60 mV in relation to the two or more types of metal members. Further, the ink-jet head of the present teaching may be either an ink-jet head of the serial type or an ink-jet head of the line type.

The water-based ink, which is applicable to the ink-jet head of the present teaching, is not specifically limited. However, it is preferable that the water-based ink contains a colorant, water, and a water-soluble organic solvent.

The colorant may be either a pigment or a dye. However, it is preferable that the colorant is a pigment. As described above, in the ink-jet head of the present teaching, the corrosion is suppressed for the metal members as a whole. Therefore, the metal is scarcely eluted into the water-based ink. Therefore, even when the ink-jet head of the present teaching is applied, for example, to a water-based pigment ink, then the clog-up or occlusion of the ink flow passage, which would be otherwise caused by the aggregation of the pigment resulting from the elution of the metal, is suppressed, and it is possible to perform the stable discharge.

The pigment is exemplified, for example, by carbon black, inorganic pigments, and organic pigments. The carbon black is exemplified, for example, by furnace black, lamp black, acetylene black, and channel black. The inorganic pigment may be exemplified, for example, by titanium oxide, inorganic pigments based on iron oxide, and inorganic pigments based on carbon black. The organic pigment is exemplified, for example, by azo-pigments such as azo lake, insoluble azo-pigment, condensed azo-pigment, chelate azo-pigment and the like; polycyclic pigments such as phthalocyanine pigment, perylene and perynon pigments, anthraquinone pigment, quinacridone pigment, dioxadine pigment, thioindigo pigment, isoindolinone pigment, quinophthalone pigment and the like; dye lake pigments such as basic dye type lake pigment, acid dye type lake pigment and the like; nitro pigments; nitroso pigments; and aniline black daylight fluorescent pigment. Any other pigment is also usable provided that the pigment is dispersible in the water phase. Specified examples of the pigments as described above include, for example, C. I. Pigment Blacks 1, 6, and 7; C. I. Pigment Yellows 1, 2, 3, 12, 13, 14, 15, 16, 17, 55, 78, 150, 151, 154, 180, 185, and 194; C. I. Pigment Oranges 31 and 43; C. I. Pigment Reds 2, 3, 5, 6, 7, 12, 15, 16, 48, 48:1, 53:1, 57, 57:1, 112, 122, 123, 139, 144, 146, 149, 166, 168, 175, 176, 177, 178, 184, 185, 190, 202, 221, 222, 224, and 238; C. I. Pigment Violet 196; C. I. Pigment Blues 1, 2, 3, 15, 15:1, 15:2, 15:3, 15:4, 16, 22, and 60; and C. I. Pigment Greens 7 and 36.

The pigment may be any self-dispersible pigment. The self-dispersible pigment is dispersible in water without using any dispersing agent, for example, owing to the fact that at least one of the hydrophilic functional group and the salt thereof including, for example, carbonyl group, hydroxyl group, carboxylic acid group, sulfonic acid group, and phosphoric acid group is introduced into the pigment particles by means of the chemical bond directly or with any other group intervening therebetween. Those usable as the self-dispersible pigment include, for example, those in which the pigment is treated or processed in accordance with any method described, for example, in Japanese Patent Application Laid-open No. 8-3498, Published Japanese Translation of PCT International Publication for Patent Application Nos. 2000-513396, 2008-524400 and 2009-515007. As for the raw material for the self-dispersible pigment, it is possible to use any one of inorganic pigments and organic pigments. The pigment, which is suitable to perform the treatment as described above, includes, for example, carbon blacks such as "MA8" and "MA100" produced by Mitsubishi Chemical Corporation. For example, any commercially available product may be used for the self-dispersible pigment. The commercially available product includes, for example, "CAB-O-JET (trade name) 200", "CAB-O-JET (trade name) 250C", "CAB-O-JET (trade name) 260M", "CAB-O-JET (trade name) 270Y", "CAB-O-JET (trade name) 300", "CAB-O-JET (trade name) 400", "CAB-O-JET (trade name) 450C", "CAB-O-JET (trade name) 465M", and "CAB-O-JET (trade name) 470Y" produced by Cabot Specialty Chemicals; "BONJET (trade name) BLACK CW-2" and "BONJET (trade name) BLACK CW-3" produced by Orient Chemical Industries, Ltd.; and "LIOJET (trade name) WD BLACK 002C" produced by Toyo Ink Mfg. Co., Ltd.

The blending amount of the solid content of the pigment with respect to the total amount of the water-based ink (pigment solid content amount) is not specifically limited, which can be appropriately determined depending on, for example, the desired optical density and the coloration or colorfulness. The pigment solid content amount is, for example, 0.1% by weight to 20% by weight, preferably 1% by weight to 10% by weight, and more preferably 2% by weight to 8% by weight.

The dye is not specifically limited, which is exemplified, for example, by direct dyes, acid dyes, basic dyes, and reactive dyes. Specified examples of the dye include, for example, C. I. Direct Black, C. I. Direct Blue, C. I. Direct Red, C. I. Direct Yellow, C. I. Direct Orange, C. I. Direct Violet, C. I. Direct Brown, C. I. Direct Green, C. I. Acid Black, C. I. Acid Blue, C. I. Acid Red, C. I. Acid Yellow, C.

I. Acid Orange, C. I. Acid Violet, C. I. Basic Black, C. I. Basic Blue, C. I. Basic Red, C. I. Basic Violet, and C. I. Food Black. C. I. Direct Black is exemplified, for example, by C. I. Direct Blacks 17, 19, 32, 51, 71, 108, 146, 154, and 168. C. I. Direct Blue is exemplified, for example, by C. I. Direct Blues 6, 22, 25, 71, 86, 90, 106, and 199. C. I. Direct Red is exemplified, for example, by C. I. Direct Reds 1, 4, 17, 28, 83, and 227. C. I. Direct Yellow is exemplified, for example, by C. I. Direct Yellows 12, 24, 26, 86, 98, 132, 142, and 173. C. I. Direct Orange is exemplified, for example, by C. I. Direct Oranges 34, 39, 44, 46, and 60. C. I. Direct Violet is exemplified, for example, by C. I. Direct Violets 47 and 48. C. I. Direct Brown is exemplified, for example, by C. I. Direct Brown 109. C. I. Direct Green is exemplified, for example, by C. I. Direct Green 59. C. I. Acid Black is exemplified, for example, by C. I. Acid Blacks 2, 7, 24, 26, 31, 52, 63, 112, and 118. C. I. Acid Blue is exemplified, for example, by C. I. Acid Blues 9, 22, 40, 59, 90, 93, 102, 104, 117, 120, 167, 229, and 234. C. I. Acid Red is exemplified, for example, by C. I. Acid Reds 1, 6, 32, 37, 51, 52, 80, 85, 87, 92, 94, 115, 180, 256, 289, 315, and 317. C. I. Acid Yellow is exemplified, for example, by C. I. Acid Yellows 11, 17, 23, 25, 29, 42, 61, and 71. C. I. Acid Orange is exemplified, for example, by C. I. Acid Oranges 7 and 19. C. I. Acid Violet is exemplified, for example, by C. I. Acid Violet 49. C. I. Basic Black is exemplified, for example, by C. I. Basic Black 2. C. I. Basic Blue is exemplified, for example, by C. I. Basic Blues 1, 3, 5, 7, 9, 24, 25, 26, 28, and 29. C. I. Basic Red is exemplified, for example, by C. I. Basic Reds 1, 2, 9, 12, 13, 14, and 37. C. I. Basic Violet is exemplified, for example, by C. I. Basic Violets 7, 14, and 27. C. I. Food Black is exemplified, for example, by C. I. Food Blacks 1 and 2.

The blending amount of the dye with respect to the total amount of the water-based ink is not specifically limited, which is, for example, 0.1% by weight to 20% by weight, and preferably 0.3% by weight to 10% by weight.

One type of the colorant may be used singly. Alternatively, two or more types of the colorants may be used in combination.

It is preferable that the water is ion exchange water or pure water. The blending amount of water (water ratio) with respect to the total amount of the water-based ink is, for example, 10% by weight to 90% by weight, and preferably 40% by weight to 80% by weight. The water ratio may be, for example, the balance of the other components.

The water-soluble organic solvent is exemplified, for example, by a humectant which prevents the water-based ink from being dried at the nozzle forward end portions of the ink-jet head and a penetrant which adjusts the drying speed on the recording medium.

The humectant described above is not specifically limited, which includes, for example, lower alcohols such as methyl alcohol, ethyl alcohol, n-propyl alcohol, isopropyl alcohol, n-butyl alcohol, sec-butyl alcohol, and tert-butyl alcohol; amides such as dimethylformamide and dimethylacetamide; ketones such as acetone; ketoalcohols (ketone alcohols) such as diacetone alcohol; ethers such as tetrahydrofuran and dioxane; polyhydric alcohols such as polyalkylene glycols, alkylene glycols, glycerol, and trimethylolpropane; 2-pyrrolidone; N-methyl-2-pyrrolidone; and 1,3-dimethyl-2-imidazolidinone. The polyalkylene glycol includes, for example, polyethylene glycol and polypropylene glycol. The alkylene glycol includes, for example, ethylene glycol, propylene glycol, butylene glycol, diethylene glycol, triethylene glycol, dipropylene glycol, tripropylene glycol, thiodiglycol, and hexylene glycol. One type of the humectant as described above may be used singly, or two or more types of the humectants as described above may be used in combination. Among them, it is preferable to use polyhydric alcohol such as alkylene glycol and glycerol.

The blending amount of the humectant with respect to the total amount of the water-based ink is, for example, 0% by weight to 95% by weight, preferably 5% by weight to 80% by weight, and more preferably 5% by weight to 50% by weight.

The penetrant includes, for example, glycol ether. Glycol ether includes, for example, ethylene glycol methyl ether, ethylene glycol ethyl ether, ethylene glycol n-propyl ether, diethylene glycol methyl ether, diethylene glycol ethyl ether, diethylene glycol n-propyl ether, diethylene glycol n-butyl ether, diethylene glycol n-hexyl ether, triethylene glycol methyl ether, triethylene glycol ethyl ether, triethylene glycol n-propyl ether, triethylene glycol n-butyl ether, propylene glycol methyl ether, propylene glycol ethyl ether, propylene glycol n-propyl ether, propylene glycol n-butyl ether, dipropylene glycol methyl ether, dipropylene glycol ethyl ether, dipropylene glycol n-propyl ether, dipropylene glycol n-butyl ether, tripropylene glycol methyl ether, tripropylene glycol ethyl ether, tripropylene glycol n-propyl ether, and tripropylene glycol n-butyl ether. One type of the penetrant as described above may be used singly, or two or more types of the penetrants as described above may be used in combination.

The blending amount of the penetrant with respect to the total amount of the water-based ink is, for example, 0% by weight to 20% by weight, preferably 0.1% by weight to 15% by weight, and more preferably 0.5% by weight to 10% by weight.

The water-based ink may further contain conventionally known additives, if necessary. The additive includes, for example, surfactants, pH-adjusting agents, viscosity-adjusting agents, surface tension-adjusting agents, and fungicides. The viscosity-adjusting agent includes, for example, polyvinyl alcohol, cellulose, and water-soluble resin.

The water-based ink can be prepared, for example, such that the colorant, water, the water-soluble organic solvent, and optionally other additive components are mixed uniformly or homogeneously by means of any conventionally known method, and undissolved matters are removed by means of a filter or the like.

Next, an explanation will be made about the ink-jet recording apparatus of the present teaching and the ink-jet recording method based on the use of the same.

The ink-jet recording apparatus of the present teaching resides in an ink-jet recording apparatus including an ink accommodating unit and an ink-jet head, for discharging the water-based ink accommodated in the ink accommodating unit by means of the ink-jet head, wherein the ink-jet head is the ink-jet head of the present teaching. The ink accommodating unit is exemplified, for example, by an ink cartridge which contains the water-based ink. For example, a conventionally known main body can be used as the main body of the ink cartridge.

Figure 3:
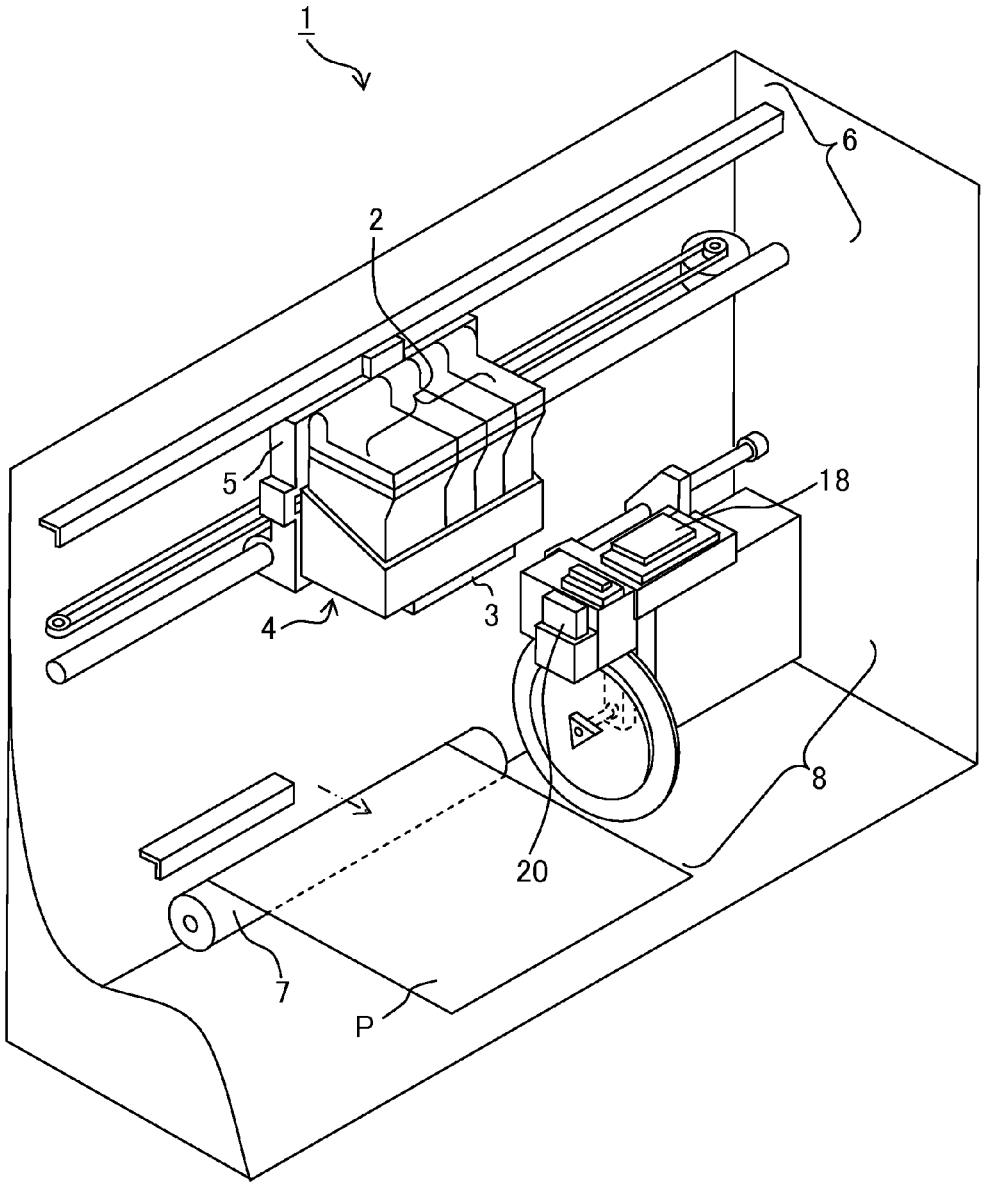
FIG. 3 shows a schematic perspective view illustrating an exemplary arrangement of an ink-jet recording apparatus of the present teaching.

FIG. 3 shows an exemplary arrangement of the ink-jet recording apparatus of the present teaching. As shown in the drawing, the ink-jet recording apparatus 1 includes, as main constitutive elements, four ink cartridges 2, an ink-jet head 3 of the present teaching, a head unit 4, a carriage 5, a driving unit 6, a platen roller 7, and a purge unit 8.

Each of the four ink cartridges 2 includes each of the four color water-based inks of yellow, magenta, cyan, and black one by one. The ink-jet head 3 of the present teaching, which is installed on the head unit 4, performs the recording on a recording medium (for example, recording paper) P. The four ink cartridges 2 and the head unit 4 are carried on the carriage 5. The driving unit 6 reciprocatively moves the carriage 5 in the linear direction. Any known driving unit, for example, a driving unit as disclosed in Japanese Patent Application Laid-open No. 2008-246821 can be used as the driving unit 6. The platen roller 7 extends in the reciprocating direction of the carriage 5, and the platen roller 7 is arranged opposingly to the ink-jet head 3 of the present teaching.

The purge unit 8 sucks any defective ink containing the bubble or the like staying at the inside of the ink-jet head 3 of the present teaching. Any known purge unit, for example, a purge unit as disclosed in Japanese Patent Application Laid-open No. 2008-246821 can be used as the purge unit 8.

A wiper member 20 is arranged adjacently to the purge unit 8 on the platen roller 7 side of the purge unit 8. The wiper member 20 is formed to have a spatula-shaped form. The wiper member 20 wipes out the nozzle-formed surface of the ink-jet head 3 of the present teaching in accordance with the movement of the carriage 5. With reference to FIG. 3, the cap 18 covers a plurality of nozzles of the ink-jet head 3 of the present teaching which is returned to the reset position when the recording is completed in order to prevent the water-based inks from being dried.

In the ink-jet recording apparatus 1 of this embodiment, the four ink cartridges 2 are carried on one carriage 5 together with the head unit 4. However, the present teaching is not limited thereto. In the ink-jet recording apparatus described above, the respective cartridges of the four ink cartridges 2 may be carried on any carriage distinctly from the head unit 4. The respective cartridges of the four ink cartridges 2 may be arranged and fixed in the ink-jet recording apparatus without being carried on the carriage 5. In the modes as described above, for example, the respective cartridges of the four ink cartridges 2 are connected to the head unit 4 carried on the carriage 5 by means of tubes or the like, and the water-based inks are supplied from the respective cartridges of the four ink cartridges 2 to the head unit 4.

The ink-jet recording, which is based on the use of the ink-jet recording apparatus 1, is carried out, for example, as follows. At first, the recording paper P is fed from a paper feed cassette (not shown) provided on the side portion of the ink-jet recording apparatus 1 or under or below the ink-jet recording apparatus 1. The recording paper P is introduced into the space between the ink-jet head 3 of the present teaching and the platen roller 7. Predetermined recording is performed on the introduced recording paper P with the water-based inks discharged from the ink-jet head 3 of the present teaching. In the ink-jet head 3 of the present teaching, the corrosion is suppressed for the metal members as a whole. Therefore, the metal is scarcely eluted into the water-based inks. Therefore, even when the ink-jet head 3 of the present teaching is applied, for example, to the water-based pigment ink, then the clog-up or occlusion of the ink flow passage, which would be otherwise caused by the aggregation of the pigment resulting from the elution of the metal, is suppressed, and the discharge can be performed stably. After the recording, the recording paper P is discharged from the ink-jet recording apparatus 1. A paper feed mechanism and a paper discharge mechanism for the recording paper P are omitted from the illustration in FIG. 3.

FIG. 3 shows the apparatus which adopts the serial type ink-jet head as the ink-jet head of the present teaching by way of example. However, the ink-jet recording apparatus of the present teaching is not limited thereto. The ink-jet recording apparatus of the present teaching may be an apparatus which adopts a line type ink-jet head as the ink-jet head of the present teaching.

According to the present teaching, there is provided a corrosion suppressing method for suppressing corrosion of a metal part with respect to a liquid, two or more types of metal members as the metal part being used at portions to be brought in contact with the liquid; wherein at least two of the two or more types of the metal members are electrically connected; and the two or more types of the electrically connected metal members have spontaneous potentials each of which is measured with a reference electrode Ag/AgCl in the liquid and which provide an absolute value of a maximum difference therebetween, the absolute value being not more than 60 mV. The corrosion suppressing method can be widely applied to various metal parts, without being limited to the ink-jet head for discharging the water-based ink. In the corrosion suppressing method, it is appropriate that various conditions, which include, for example, those of the method for measuring the spontaneous potential described above, are the same as or equivalent to those for the ink-jet head of the present teaching.

According to the present teaching, there is provided a method for producing an ink-jet head for discharging a water-based ink for ink-jet recording; including using two or more types of metal parts at portions to be brought in contact with the water-based ink; wherein at least two of the two or more types of the metal parts are electrically connected; and the two or more types of the electrically connected metal parts have spontaneous potentials each of which is measured with a reference electrode Ag/AgCl in the water-based ink and which provide an absolute value of a maximum difference therebetween, the absolute value being not more than 60 mV. In the method for producing the ink-jet head, it is appropriate that various conditions, which include, for example, those of the method for measuring the spontaneous potential described above, are the same as or equivalent to those for the ink-jet head of the present teaching.

EXAMPLES

Next, Examples of the present teaching will be explained together with Comparative Examples. It is noted that the present teaching is not limited and restricted to Examples and Comparative Examples described below.

[Preparatory Experiment]

Thin plate-shaped metal members (1000 $mm^2$) of SUS430, SUS430BA, SUS304, 42 Alloy, NK-430MA, and iron (Fe) were prepared, and the corrosion resistance of each of the metal members against the ink was inspected as follows. An ink solvent was obtained by uniformly mixing components except for self-dispersible carbon black contained in a water-based ink composition of BK-1 shown in Table 2. Subsequently, the ink solvent was added to self-dispersible carbon black dispersed in water, followed by being uniformly mixed. After that, an obtained mixture was filtrated through a cellulose acetate type membrane filter produced by Toyo Roshi Kaisha, Ltd. (pore size: 3.00 μm), and thus a water-based ink for ink-jet recording BK-1 was obtained. Each of the six types of the metal members described above was immersed in 10 mL of the water-based ink charged in a hermetically sealed container, followed by being left to stand for 4 weeks in a thermostatic chamber at a temperature of 60° C. After that, the amount of metal, which was eluted into the water-based ink, was measured by ICP light emission spectroscopic analysis apparatus (CIROS-120EOP produced by Rigaku), and the elution of metal was evaluated in accordance with the following criteria.

<Evaluation Criteria for Metal Elution Test>

AA: Metal elution amount from the metal member into the water-based ink was not more than 1 ppm.

A: Metal elution amount from the metal member into the water-based ink was above 1 ppm and not more than 5 ppm.

B: Metal elution amount from the metal member into the water-based ink was above 5 ppm and not more than 10 ppm.

C: Metal elution amount from the metal member into the water-based ink was above 10 ppm.

Evaluation results are shown below.

| <Metal species (types)> | <Evaluation result> |
|---|---|
| SUS430BA | AA |
| SUS304 | AA |
| NK-430MA | AA |
| SUS444 | AA |
| SUS430 | A |
| 42 Alloy | C |
| Fe | C |

According to the foregoing results, the following fact is appreciated. That is, SUS430BA, SUS304, NK-430MA, and SUS444 are the most excellent in the corrosion resistance against the ink, and SUS430 is the second most excellent. Further, 42 Alloy and Fe are inferior as compared therewith. In Examples of Comparative Examples described below, the foregoing metal members were used singly or in combination. However, when the metal members were combined, the metal members, which had the different evaluation results of the metal elution, were combined on the basis of the evaluation results.

Examples 1-1 to 1-9 and Comparative Example 1-1

First metal members (SUS430, SUS430BA, SUS304, or 42 Alloy) and second metal members (42 Alloy) shown in Table 3 were prepared so that the ratio {(Y/X)×100} had values shown in Table 3. In Comparative Example 1-1, only 42 Alloy was used as the material for forming the metal member.

The metal elution test was performed by means of the following method for Examples 1-1 to 1-9 and Comparative Example 1-1.

<Metal Elution Test Method>

Ink solvents were obtained by uniformly mixing components except for self-dispersible carbon black contained in water-based ink compositions (Table 2). Subsequently, the ink solvents were added to self-dispersible carbon black dispersed in water, followed by being uniformly mixed. After that, obtained mixtures were filtrated through a cellulose acetate type membrane filter produced by Toyo Roshi Kaisha, Ltd. (pore size: 3.00 μm), and thus water-based inks for ink-jet recording BK-1 to BK-3 were obtained. The first metal members and the second metal members of Examples 1-1 to 1-9 and Comparative Example 1-1 were prepared so that the total surface area was 1000 $mm^2$ and the ratio {(Y/X)×100} had values shown in Table 3. The members were connected by using copper wires, and the copper wire portions were coated with a sealing material made of silicon (Silicon Sealant 8060 Pro produced by Cemedine Co., Ltd.) so that the copper wire portions were not brought in contact with the water-based ink. The metal member was immersed in 10 mL of the water-based ink charged in a hermetically sealed container, followed by being left to stand for 4 weeks in a thermostatic chamber at a temperature of 60° C. After that, the amount of metal, which was eluted into the water-based ink, was measured by ICP light emission spectroscopic analysis apparatus (CIROS-120EOP produced by Rigaku), and the elution of metal was evaluated in accordance with the following criteria. The result of this metal elution test exhibits the correlation with the discharge stability and the enduring discharge stability as described later on. If the result of this metal elution test is satisfactory, it can be judged that the discharge stability and the enduring discharge stability are excellent.

TABLE 2

| | BK-1 | BK-2 | BK-3 |
|---|---|---|---|
| CAB-O-JET (trade name) 300 (*2) | 40 (6) | 50 (7.5) | 30 (4.5) |
| Glycerol | 15 | — | 10 |
| Diethylene glycol | — | 10 | — |
| Polyethylene glycol 200 | — | — | 10 |
| Triethylene glycol monobutyl ether | 5 | — | — |
| Dipropylene glycol propyl ether | — | 2 | — |
| 1,5-Pentanediol | — | — | 5 |
| Olfine (trade name) E1010 (*6) | 0.5 | — | — |
| Sunnol (trade name) NL-1430 (*7) | — | 1 | — |
| 1,2,3-Benzotriazole | 0.1 | — | 0.1 |
| Water | balance | balance | balance |

(*2): Self-dispersible carbon black; produced by Cabot Specialty Chemicals; carbon black concentration = 15% by weight; parenthesized numeral indicates pigment solid content.
(*6): Ethylene oxide (10 moles) adduct of acetylene diol: produced by Nissin Chemical Industry Co., Ltd.
(*7): Sodium polyoxyethylene alkyl (C = 12, 13) ether sulfate (3E.O.); produced by Lion Corporation; active component amount: 28% by weight; numerical value in Table indicates active component amount.

<Evaluation Criteria for Metal Elution Test>

A: Metal elution amount from the first metal member and the second metal member into the water-based ink was not more than 5 ppm.

B: Metal elution amount from the first metal member and the second metal member into the water-based ink was above 5 ppm and not more than 10 ppm.

C: Metal elution amount from the first metal member and the second metal member into the water-based ink was above 10 ppm.

Table 3 shows the first metal member, the second metal member, the type of the used water-based ink, the absolute value of the difference between the spontaneous potential of the first metal member and the spontaneous potential of the second metal member with respect to the water-based ink, the ratio {(Y/X)×100}, and the evaluation result of the metal elution test in each of Examples 1-1 to 1-9 and Comparative Example 1-1.

TABLE 3

| First metal member | Second metal member | Water-based ink | Absolute value of difference between spontaneous potentials (mV) | Example 1-1 | 1-2 | 1-3 | 1-4 | 1-5 | 1-6 | 1-7 | 1-8 | 1-9 | Comp. Ex. 1-1 |
|---|---|---|---|---|---|---|---|---|---|---|---|---|---|
| | | | | Ratio {(Y/X) × 100} (%) | | | | | | | | | |
| SUS430 | 42 Alloy | BK-1 | 4 | 66.7 | 42.9 | 33.3 | 20.0 | — | — | — | — | — | — |
| SUS430 | 42 Alloy | BK-3 | 6 | — | — | — | — | 50.0 | 37.5 | 25.0 | — | — | — |
| SUS430BA | 42 Alloy | BK-3 | 16 | — | — | — | — | — | — | — | 50.0 | — | — |
| SUS304 | 42 Alloy | BK-1 | 1 | — | — | — | — | — | — | — | — | 50.0 | — |
| 42 Alloy | — | BK-2 | — | — | — | — | — | — | — | — | — | — | 100 |
| Metal elution test | | | | A | A | B | B | A | A | B | A | A | C |

As shown in Table 3, the evaluation result of the metal elution test was satisfactory, the corrosion resistance of the metal member (42 Alloy as the second metal member) having the low corrosion resistance against the water-based ink was improved or raised to the level approximate to that of the metal member (first metal member) having the high corrosion resistance against the water-based ink, and the corrosion was suppressed for the metal members as a whole in Examples 1-1 to 1-9 in which the material for forming the second metal member was 42 Alloy as compared with Comparative Example 1-1 in which only 42 Alloy was used as the material for forming the metal member. The evaluation result of the metal elution test was especially excellent in Examples 1-1, 1-2, 1-5, 1-6, 1-8, and 1-9 in which the ratio {(Y/X)×100} was 37.5% to 66.7%.

The discharge stability evaluation and the enduring discharge stability evaluation were performed in accordance with the following method for Example 1-2 and Comparative Example 1-1.

<Evaluation of Discharge Stability>

An ink-jet head having a stacked structure as shown in FIG. 1 was manufactured by using the first metal member (SUS430) and the second metal member (42 Alloy) so that ratio {(Y/X)×100} was 42.9%. The water-based ink was introduced into the ink-jet head to perform the continuous recording of one hundred million dots (about thirty thousand sheets). As for the metals for constructing the ink flow passage of the ink-jet head, the first metal member (SUS430) was used for the damper plate, and the second metal member (42 Alloy) was used for the other plates. As a result, the discharge failure and the discharge bending were not caused at all, and the satisfactory discharge stability was exhibited. On the other hand, when the ink flow passage of the ink-jet head was constructed by using the second metal member (42 Alloy) for all of the plates including the damper plate as well (Comparative Example 1-1), then the discharge bending of the ink was caused after the recording of about ten thousand sheets, and the discharge gradually disappeared. The discharge failure is such a state that the nozzles of the ink-jet head are clogged up and the water-based ink is not discharged. The discharge bending is such a state that some of the nozzles of the ink-jet head are clogged up, the water-based ink is not discharged perpendicularly with respect to the recording paper, and the water-based ink is discharged obliquely.

<Evaluation of Enduring Discharge Stability>

The water-based ink was introduced into an ink-jet head which was manufactured in the same manner as in the discharge stability evaluation, followed by being left to stand for 2 weeks in an environment at 60° C. After that, the continuous recording of one hundred million dots (about thirty thousand sheets) was performed. As a result, the discharge failure and the discharge bending were not caused at all, and the satisfactory enduring discharge stability was exhibited.

Examples 2-1 to 2-5 and Comparative Examples 2-1 to 2-3

First metal members (NK-430MA, SUS444, SUS304, SUS430, or Fe) and second metal members (SUS430 or Fe) shown in Table 4 were prepared so that the ratio {(Y/X)×100} had values shown in Table 4. In Comparative Example 2-2, only SUS430 was used as the material for forming the metal member. In Comparative Example 2-3, only Fe was used as the material for forming the metal member.

The metal elution test was performed for Examples 2-1 to 2-5 and Comparative Examples 2-1 to 2-3 in the same manner as in Examples 1-1 to 1-9 and Comparative Example 1-1. The elution of the metal was evaluated in accordance with the following evaluation criteria. In Examples 2-1 to 2-5, the metal species (types), which exhibited the satisfactory results in the metal elution test, were used as the first metal member and the second metal member. Therefore, the evaluation AA, which was more satisfactory than the evaluation A in the evaluation criteria in Example 1, was added.

<Evaluation Criteria for Metal Elution Test>

AA: Metal elution amount from the first metal member and the second metal member into the water-based ink was not more than 1 ppm.

A: Metal elution amount from the first metal member and the second metal member into the water-based ink was above 1 ppm and not more than 5 ppm.

B: Metal elution amount from the first metal member and the second metal member into the water-based ink was above 5 ppm and not more than 10 ppm.

C: Metal elution amount from the first metal member and the second metal member into the water-based ink was above 10 ppm.

Table 4 shows the first metal member, the second metal member, the type of the used water-based ink, the absolute value of the difference between the spontaneous potential of the first metal member and the spontaneous potential of second metal member with respect to the water-based ink, the ratio {(Y/X)×100}, and the evaluation result of the metal elution test in each of Examples 2-1 to 2-5 and Comparative Examples 2-1 to 2-3.

TABLE 4

| First metal member | Second metal member | Water-based ink | Absolute value of difference between spontaneous potentials (mV) | Example 2-1 | 2-2 | 2-3 | 2-4 | 2-5 | Comp. Ex. 2-1 | 2-2 | 2-3 |
|---|---|---|---|---|---|---|---|---|---|---|---|
| | | | | Ratio {(Y/X) × 100} (%) | | | | | | | |
| NK-430MA | SUS430 | BK-1 | 21 | 50.0 | — | — | — | — | — | — | — |
| NK-430MA | SUS430 | BK-2 | 18 | — | 83.3 | — | — | — | — | — | — |
| NK-430MA | SUS430 | BK-3 | 30 | — | — | 60.0 | — | — | — | — | — |
| SUS444 | SUS430 | BK-2 | 60 | — | — | — | 50.0 | — | — | — | — |
| SUS304 | SUS430 | BK-3 | 5 | — | — | — | — | 50.0 | — | — | — |
| NK-430MA | Fe | BK-1 | 175 | — | — | — | — | — | 50.0 | — | — |
| SUS430 | — | BK-3 | — | — | — | — | — | — | — | 100 | — |
| Fe | — | BK-3 | — | — | — | — | — | — | — | — | 100 |
| Metal elution test | | | | AA | AA | AA | AA | AA | C | A | C |

As shown in Table 4, the evaluation result of the metal elution test was satisfactory, the corrosion resistance of the metal member (SUS430 as the second metal member) having the low corrosion resistance against the water-based ink was improved or raised to the level approximate to that of the metal member (first metal member) having the high corrosion resistance against the water-based ink, and the corrosion was suppressed for the metal members as a whole in Examples 2-1 to 2-5 in which the material for forming the second metal member was SUS430 as compared with Comparative Example 2-2 in which only SUS430 was used as the material for forming the metal member. On the other hand, the evaluation result of the metal elution test was inferior in Comparative Example 2-1 in which the absolute value of the difference between the spontaneous potential of the first metal member and the spontaneous potential of the second metal member with respect to the water-based ink was 175 mV and Comparative Example 2-3 in which only Fe was used as the material for forming the metal member, as compared with Comparative Example 2-2.

Examples 3-1 to 3-4 and Comparative Examples 3-1 to 3-2

First metal members (NK-430MA, SUS430, or 42 Alloy) and second metal members (42 Alloy or Fe) shown in Table 6 were prepared so that the ratio {(Y/X)×100} had values shown in Table 6. In Comparative Example 3-2, only 42 Alloy was used as the material for forming the metal member.

The metal elution test was performed by means of the following method for Examples 3-1 to 3-4 and Comparative Examples 3-1 to 3-2.

<Metal Elution Test Method>

Ink solvents were obtained by uniformly mixing components except for self-dispersible pigments contained in water-based ink compositions (Table 5). Subsequently, the ink solvents were added to self-dispersible pigments dispersed in water, followed by being uniformly mixed. After that, obtained mixtures were filtrated through a cellulose acetate type membrane filter produced by Toyo Roshi Kaisha, Ltd. (pore size: 3.00 μm), and thus water-based inks for ink-jet recording Y-1, M-1, and C-1 were obtained. The metal elution test was performed for the first metal members and the second metal members of Examples 3-1 to 3-4 and Comparative Examples 3-1 to 3-2 in the same manner as in Examples 1-1 to 1-9 and Comparative Example 1-1, and the elution of metal was evaluated in accordance with the following evaluation criteria.

TABLE 5

| | Y-1 | M-1 | C-1 |
|---|---|---|---|
| CAB-O-JET (trade name) 470Y (*3) | 40 (6) | — | — |
| CAB-O-JET (trade name) 465M (*4) | — | 20 (3) | — |
| CAB-O-JET (trade name) 450C (*5) | — | — | 30 (4.5) |
| Glycerol | 5 | — | 10 |
| Diethylene glycol | — | 10 | — |
| Polyethylene glycol 200 | — | — | 5 |
| 2-Pyrrolidone | 10 | | — |
| Triethylene glycol monobutyl ether | — | 2 | 5 |
| Dipropylene glycol propyl ether | 2 | — | — |
| 1,5-Pentanediol | — | 2 | — |
| Olfine (trade name) E1010 (*6) | 0.3 | — | — |
| Sunnol (trade name) NL-1430 (*7) | — | 1 | — |
| 1,2,3-Benzotriazole | — | — | 0.1 |
| Water | balance | balance | balance |

(*3): Self-dispersible yellow pigment; produced by Cabot Specialty Chemicals; pigment concentration = 15% by weight; parenthesized numeral indicates pigment solid content.

(*4): Self-dispersible magenta pigment; produced by Cabot Specialty Chemicals; pigment concentration = 15% by weight; parenthesized numeral indicates pigment solid content.

(*5): Self-dispersible cyan pigment; produced by Cabot Specialty Chemicals; pigment concentration = 15% by weight; parenthesized numeral indicates pigment solid content.

(*6): Ethylene oxide (10 moles) adduct of acetylene diol: produced by Nissin Chemical Industry Co., Ltd.

(*7): Sodium polyoxyethylene alkyl (C = 12, 13) ether sulfate (3E.O.); produced by Lion Corporation; active component amount: 28% by weight; numerical value in Table indicates active component amount.

<Evaluation Criteria for Metal Elution Test>

A: Metal elution amount from the first metal member and the second metal member into the water-based ink was not more than 5 ppm.

B: Metal elution amount from the first metal member and the second metal member into the water-based ink was above 5 ppm and not more than 10 ppm.

C: Metal elution amount from the first metal member and the second metal member into the water-based ink was above 10 ppm.

Table 6 shows the first metal member, the second metal member, the type of the used water-based ink, the absolute value of the difference between the spontaneous potential of the first metal member and the spontaneous potential of the second metal member with respect to the water-based ink, the ratio {(Y/X)×100}, and the evaluation result of the metal elution test in each of Examples 3-1 to 3-4 and Comparative Examples 3-1 to 3-2.

TABLE 6

| First metal member | Second metal member | Water-based ink | Absolute value of difference between spontaneous potentials (mV) | Example 3-1 | Example 3-2 | Example 3-3 | Example 3-4 | Comp. Ex. 3-1 | Comp. Ex. 3-2 |
|---|---|---|---|---|---|---|---|---|---|
| | | | | Ratio {(Y/X) × 100} (%) | | | | | |
| NK-430MA | 42 Alloy | Y-1 | 44 | 50.0 | — | — | — | — | — |
| SUS430 | 42 Alloy | M-1 | 42 | — | 50.0 | — | — | — | — |
| NK-430MA | 42 Alloy | M-1 | 28 | — | — | 50.0 | — | — | — |
| SUS430 | 42 Alloy | C-1 | 30 | — | — | — | 50.0 | — | — |
| 42 Alloy | Fe | M-1 | 69 | — | — | — | — | 50.0 | — |
| 42 Alloy | — | M-1 | — | — | — | — | — | — | 100 |
| Metal elution test | | | | A | A | A | A | C | C |

As shown in Table 6, the evaluation result of the metal elution test was satisfactory, the corrosion resistance of the metal member (42 Alloy as the second metal member) having the low corrosion resistance against the water-based ink was improved or raised to the level approximate to that of the metal member (first metal member) having the high corrosion resistance against the water-based ink, and the corrosion was suppressed for the metal members as a whole in Examples 3-1 to 3-4 in which the material for forming the second metal member was 42 Alloy as compared with Comparative Example 3-2 in which only 42 Alloy was used as the material for forming the metal member. On the other hand, in Comparative Example 3-1 in which the absolute value of the difference between the spontaneous potential of the first metal member and the spontaneous potential of the second metal member with respect to the water-based ink was 69 mV, the evaluation result of the metal elution test was equivalent to that obtained in Comparative Example 3-2.

Examples 4-1 to 4-2 and Comparative Examples 4-1 to 4-3

First metal members (SUS444, NK-430MA, SUS430, or Fe) and second metal members (SUS430 or Fe) shown in Table 7 were prepared so that the ratio {(Y/X)×100} had values shown in Table 7. In Comparative Example 4-2, only SUS430 was used as the material for forming the metal member. In Comparative Example 4-3, only Fe was used as the material for forming the metal member.

Table 7 shows the first metal member, the second metal member, the type of the used water-based ink, the absolute value of the difference between the spontaneous potential of the first metal member and the spontaneous potential of the second metal member with respect to the water-based ink, the ratio {(Y/X)×100}, and the evaluation result of the metal elution test in each of Examples 4-1 to 4-2 and Comparative Examples 4-1 to 4-3.

As shown in Table 7, the evaluation result of the metal elution test was satisfactory, the corrosion resistance of the metal member (SUS430 as the second metal member) having the low corrosion resistance against the water-based ink was improved or raised to the level approximate to that of the metal member (first metal member) having the high corrosion resistance against the water-based ink, and the corrosion was suppressed for the metal members as a whole in Examples 4-1 to 4-2 in which the material for forming the second metal member was SUS430 as compared with Comparative Example 4-2 in which only SUS430 was used as the material for forming the metal member. On the other hand, the evaluation result of the metal elution test was inferior in Comparative Example 4-1 in which the absolute value of the difference between the spontaneous potential of the first metal member and the spontaneous potential of the second metal member with respect to the water-based ink was 80 mV and Comparative Example 4-3 in which only Fe was used as the material for forming the metal member, as compared with Comparative Example 4-2.

Examples 5-1 to 5-4 and Comparative Examples 5-1 to 5-2

First metal members (SUS430, NK-430MA, or 42 Alloy) and second metal members (42 Alloy or Fe) shown in Table 9 were prepared so that the ratio {(Y/X)×100} had values shown in Table 9. In Comparative Example 5-2, only 42 Alloy was used as the material for forming the metal member.

The metal elution test was performed by means of the following method for Examples 5-1 to 5-4 and Comparative Examples 5-1 to 5-2.

<Metal Elution Test Method>

Respective components of water-based ink compositions (Table 8) were uniformly mixed. After that, obtained mixtures were filtrated through a hydrophilic polytetrafluoro-

TABLE 7

| First metal member | Second metal member | Water-based ink | Absolute value of difference between spontaneous potentials (mV) | Example 4-1 | Example 4-2 | Comp. Ex. 4-1 | Comp. Ex. 4-2 | Comp. Ex. 4-3 |
|---|---|---|---|---|---|---|---|---|
| | | | | Ratio {(Y/X) × 100} (%) | | | | |
| SUS444 | SUS430 | Y-1 | 20 | 50.0 | — | — | — | — |
| NK-430MA | SUS430 | C-1 | 38 | — | 50.0 | — | — | — |
| NK-430MA | Fe | Y-1 | 80 | — | — | 50.0 | — | — |
| SUS430 | — | M-1 | — | — | — | — | 100 | — |
| Fe | — | C-1 | — | — | — | — | — | 100 |
| Metal elution test | | | | AA | AA | C | A | C |

ethylene (PTFE) type membrane filter produced by Toyo Roshi Kaisha, Ltd. (pore size: 0.20 μm), and thus water-based inks for ink-jet recording Y-2, M-2, and C-2 were obtained. The metal elution test was performed for the first metal members and the second metal members of Examples 5-1 to 5-4 and Comparative Examples 5-1 to 5-2 in the same manner as in Examples 1-1 to 1-9 and Comparative Example 1-1, and the elution of metal was evaluated in accordance with the following evaluation criteria.

TABLE 8

| | Y-2 | M-2 | C-2 |
|---|---|---|---|
| C.I. Direct Yellow 86 | 2 | — | — |
| C.I. Direct Yellow 132 | 6 | — | — |
| C.I. Acid Red 52 | — | 2 | — |
| C.I. Direct Blue 199 | — | — | 4 |
| Glycerol | — | 15 | 10 |
| Polyethylene glycol 200 | 20 | — | — |
| 2-Pyrrolidone | — | — | 10 |
| Triethylene glycol monobutyl ether | 3.0 | — | — |
| Dipropylene glycol propyl ether | — | 1.5 | — |
| 1,2-Hexanediol | — | — | 5 |
| Triethanolamine | 0.2 | — | — |
| Olfine (trade name) E1010 (*6) | 0.3 | 0.5 | — |
| Sunnol (trade name) NL-1430 (*7) | — | 1 | 1 |
| 1,2,3-Benzotriazole | — | 0.1 | 0.1 |
| Water | balance | balance | balance |

(*6): Ethylene oxide (10 moles) adduct of acetylene diol: produced by Nissin Chemical Industry Co., Ltd.
(*7): Sodium polyoxyethylene alkyl (C = 12, 13) ether sulfate (3E.O.); produced by Lion Corporation; active component amount: 28% by weight; numerical value in Table indicates active component amount.

<Evaluation Criteria for Metal Elution Test>

A: Metal elution amount from the first metal member and the second metal member into the water-based ink was not more than 5 ppm.

B: Metal elution amount from the first metal member and the second metal member into the water-based ink was above 5 ppm and not more than 10 ppm.

C: Metal elution amount from the first metal member and the second metal member into the water-based ink was above 10 ppm.

Table 9 shows the first metal member, the second metal member, the type of the used water-based ink, the absolute value of the difference between the spontaneous potential of the first metal member and the spontaneous potential of the second metal member with respect to the water-based ink, the ratio {(Y/X)×100}, and the evaluation result of the metal elution test in each of Examples 5-1 to 5-4 and Comparative Examples 5-1 to 5-2.

As shown in Table 9, the evaluation result of the metal elution test was satisfactory, the corrosion resistance of the metal member (42 Alloy as the second metal member) having the low corrosion resistance against the water-based ink was improved or raised to the level approximate to that of the metal member (first metal member) having the high corrosion resistance against the water-based ink, and the corrosion was suppressed for the metal members as a whole in Examples 5-1 to 5-4 in which the material for forming the second metal member was 42 Alloy as compared with Comparative Example 5-2 in which only 42 Alloy was used as the material for forming the metal member. On the other hand, in Comparative Example 5-1 in which the absolute value of the difference between the spontaneous potential of the first metal member and the spontaneous potential of the second metal member with respect to the water-based ink was 72 mV, the evaluation result of the metal elution test was equivalent to that obtained in Comparative Example 5-2.

Examples 6-1 to 6-2 and Comparative Examples 6-1 to 6-2

First metal members (NK-430MA, SUS304, SUS430, or Fe) and second metal members (SUS430) shown in Table 10 were prepared so that the ratio {(Y/X)×100} had values shown in Table 10. In Comparative Example 6-1, only SUS430 was used as the material for forming the metal member. In Comparative Example 6-2, only Fe was used as the material for forming the metal member.

Table 10 shows the first metal member, the second metal member, the type of the used water-based ink, the absolute value of the difference between the spontaneous potential of the first metal member and the spontaneous potential of the second metal member with respect to the water-based ink, the ratio {(Y/X)×100}, and the evaluation result of the metal elution test in each of Examples 6-1 to 6-2 and Comparative Examples 6-1 to 6-2.

TABLE 9

| First metal member | Second metal member | Water-based ink | Absolute value of difference between spontaneous potentials (mV) | Example 5-1 | Example 5-2 | Example 5-3 | Example 5-4 | Comp. Ex. 5-1 | Comp. Ex. 5-2 |
|---|---|---|---|---|---|---|---|---|---|
| | | | | Ratio {(Y/X) × 100} (%) | | | | | |
| SUS430 | 42 Alloy | Y-2 | 17 | 50.0 | — | — | — | — | — |
| SUS430 | 42 Alloy | M-2 | 55 | — | 50.0 | — | — | — | — |
| NK-430MA | 42 Alloy | M-2 | 18 | — | — | 50.0 | — | — | — |
| SUS430 | 42 Alloy | C-2 | 28 | — | — | — | 50.0 | — | — |
| 42 Alloy | Fe | M-2 | 72 | — | — | — | — | 50.0 | — |
| 42 Alloy | — | Y-2 | — | — | — | — | — | — | 100 |
| | Metal elution test | | | A | A | A | A | C | C |

TABLE 10

| First metal member | Second metal member | Water-based ink | Absolute value of difference between spontaneous potentials (mV) | Example 6-1 Ratio {(Y/X) × 100} (%) | Example 6-2 Ratio {(Y/X) × 100} (%) | Comp. Ex. 6-1 Ratio {(Y/X) × 100} (%) | Comp. Ex. 6-2 Ratio {(Y/X) × 100} (%) |
|---|---|---|---|---|---|---|---|
| NK-430MA | SUS430 | Y-2 | 38 | 50.0 | — | — | — |
| SUS304 | SUS430 | C-2 | 10 | — | 50.0 | — | — |
| SUS430 | — | Y-2 | — | — | — | 100 | — |
| Fe | — | C-2 | — | — | — | — | 100 |
| Metal elution test | | | | AA | AA | A | C |

As shown in Table 10, the evaluation result of the metal elution test was satisfactory, the corrosion resistance of the metal member (SUS430 as the second metal member) having the low corrosion resistance against the water-based ink was improved or raised to the level approximate to that of the metal member (first metal member) having the high corrosion resistance against the water-based ink, and the corrosion was suppressed for the metal members as a whole in Examples 6-1 to 6-2 in which the material for forming the second metal member was SUS430 as compared with Comparative Example 6-1 in which only SUS430 was used as the material for forming the metal member. On the other hand, the evaluation result of the metal elution test was inferior in Comparative Example 6-2 in which only Fe was used as the material for forming the metal member, as compared with Comparative Example 6-1.

As described above, in the ink-jet head of the present teaching, the corrosion is suppressed for the metal members as a whole. The way of use of the ink-jet head of the present teaching is not specifically limited. The ink-jet head of the present teaching is widely applicable to various types of the ink-jet recording. The present teaching has been specifically explained on the basis of Examples. However, the present teaching is not limited thereto. Those which can be provided by any modification within the scope of the definition of appended claims are also included in the scope of the present teaching.

What is claimed is:

1. An ink-jet head for discharging a water-based ink for ink-jet recording, comprising:

a flow passage unit which has a plurality of nozzles, a plurality of pressure chambers which correspond to the plurality of nozzles, a first flow passage for the water-based ink to be supplied to the plurality of pressure chambers, and a second flow passage for the water-based ink to be supplied from the plurality of pressure chambers to the plurality of nozzles, and an actuator which is joined to the flow passage unit to cover the plurality of pressure chambers of the flow passage unit and which pressurizes the water-based ink contained in the plurality of pressure chambers, wherein the first flow passage is formed with portions, of the flow passage unit, which are to be brought in contact with the water-based ink and which are formed by two or more types of metal members, wherein:

at least two of the two or more types of the metal members are electrically connected;

the two or more types of the electrically connected metal members have spontaneous potentials each of which is measured with a reference electrode Ag/AgCl in the water-based ink and which provide an absolute value of a maximum difference therebetween, the absolute value being not more than 60 mV;

a ratio {(Y/X)×100} of a contact area (Y), of which a first metal member having the highest corrosion resistance against the water-based ink contacts with the water-based ink, with respect to a total (X) of contact areas, of which the two or more types of the electrically connected metal members contact with the water-based ink, is not more than 83.3%, wherein the contact area (Y) includes all of metal members having the highest corrosion resistance against the water-based ink among the two or more types of the electrically connected metal members;

the ratio {(Y/X)×100} is not less than 20%;

the first flow passage for the water-based ink is formed by a stacked structure in which a plurality of metal plates are stacked in the ink-jet head;

the first metal member and a second metal member which has the lowest corrosion resistance against the water-based ink among the two or more types of the electrically connected metal members are provided respectively as a first metal plate and a second metal plate for forming a part of the stacked structure;

the flow passage unit is formed with a common liquid chamber for accommodating the ink to be supplied to the plurality of pressure chambers; and the plurality of metal plates include a throttle plate, a damper plate, and a manifold plate which is provided therebetween, the common liquid chamber is defined by the throttle plate, the manifold plate, and the damper plate; wherein the damper plate, the throttle plate, or both are formed by the first metal member, and the manifold plate is formed by the second metal member.

2. The ink-jet head according to claim 1, wherein the ratio {(Y/X)×100} is not less than 35%.

3. The ink-jet head according to claim 1, wherein the first metal plate and the second metal plate are stacked adjacently.

4. The ink-jet head according to claim 1, wherein a recess is formed on a first surface of the damper plate opposite to a second surface of the damper plate defining the common liquid chamber, and a gap is formed by the recess between the first surface and the plate to be joined to the first surface.

5. The ink-jet head according to claim 1, wherein the damper plate, the throttle plate, or both are formed of SUS430, SUS430BA, SUS304, or NK-430MA, and the manifold plate is formed of 42 Alloy.

6. The ink-jet head according to claim 1, wherein the damper plate, the throttle plate, or both are formed of NK-430MA, SUS304, or SUS444, and the manifold plate is formed of SUS430.

7. The ink-jet head according to claim 1, wherein the water-based ink contains carbon black.

8. An ink-jet recording apparatus comprising:

an ink accommodating unit which accommodates a water-based ink for ink-jet recording and the ink-jet head as defined in claim 1 which discharges the water-based ink for ink-jet recording accommodated in the ink accommodating unit.

9. The ink-jet head according to claim 1, wherein the ink-jet head has manifold plates which are to be brought in contact with the water-based ink, and the manifold plates are formed by the two or more types of the metal members.

* * * * *